US007579047B2

(12) United States Patent
DeMott et al.

(10) Patent No.: US 7,579,047 B2
(45) Date of Patent: Aug. 25, 2009

(54) LUBRICANT AND SOIL RELEASE FINISH FOR TEXTURED YARNS, METHODS USING SAME AND FABRICS PRODUCED THEREFROM

(75) Inventors: Roy P. DeMott, Spartanburg, SC (US); Jerry King, Reidville, SC (US); James T. Greer, Moore, SC (US)

(73) Assignee: Milliken & Company, Spartanburg, SC (US)

( * ) Notice: Subject to any disclaimer, the term of this patent is extended or adjusted under 35 U.S.C. 154(b) by 594 days.

(21) Appl. No.: 10/441,502

(22) Filed: May 20, 2003

(65) Prior Publication Data

US 2004/0234758 A1 Nov. 25, 2004

(51) Int. Cl.
*B05D 3/02* (2006.01)
*B65H 18/28* (2006.01)

(52) U.S. Cl. ..... 427/389.9; 427/393.4; 427/394; 242/159

(58) Field of Classification Search ..... 428/364, 428/375, 395, 378; 427/389.9, 392, 393.1, 427/393.2, 393.4, 394, 385.5, 396
See application file for complete search history.

(56) References Cited

U.S. PATENT DOCUMENTS

| | | | | |
|---|---|---|---|---|
| 3,338,830 | A * | 8/1967 | Stokes et al. | 428/395 |
| 3,416,952 | A | 12/1968 | McIntyre et al. | |
| 3,546,008 | A | 12/1970 | Shields et al. | |
| 3,625,754 | A | 12/1971 | Dunn | 428/395 |
| 3,682,583 | A | 8/1972 | Kravetz et al. | 8/138 |
| 3,779,993 | A | 12/1973 | Kibler et al. | |
| 3,899,614 | A | 8/1975 | Okamoto et al. | 427/175 |
| 3,959,230 | A | 5/1976 | Hays | 528/297 |
| 3,979,306 | A | 9/1976 | Arai et al. | |
| 4,015,317 | A | 4/1977 | Johnsen | |
| 4,035,531 | A | 7/1977 | Lark | |
| 4,111,816 | A | 9/1978 | Login | |
| 4,145,461 | A | 3/1979 | Lerman et al. | |
| 4,158,083 | A | 6/1979 | Login | |
| 4,215,026 | A | 7/1980 | Login | |
| 4,216,260 | A | 8/1980 | Buckley | |
| 4,314,000 | A | 2/1982 | Thir et al. | |
| 4,370,143 | A | 1/1983 | Bauer | 8/493 |
| 4,640,946 | A * | 2/1987 | Vassallo et al. | 524/45 |
| 4,756,714 | A | 7/1988 | Hendrix et al. | |
| 4,844,709 | A | 7/1989 | Marten | |
| 4,845,140 | A | 7/1989 | Marten | |
| 4,977,191 | A | 12/1990 | Salsman | |
| 4,981,905 | A | 1/1991 | Simons et al. | |
| 5,156,651 | A | 10/1992 | Girardeau et al. | |
| 5,290,631 | A | 3/1994 | Fleury et al. | |
| 5,362,515 | A | 11/1994 | Hayes et al. | 427/155 |
| 5,421,378 | A | 6/1995 | Bowers et al. | 139/435.1 |
| 5,503,197 | A | 4/1996 | Bower et al. | 139/435.1 |
| 5,525,702 | A | 6/1996 | Nace | |
| 5,569,408 | A | 10/1996 | Peppmoller et al. | |
| 5,571,620 | A | 11/1996 | George et al. | |
| 5,626,952 | A | 5/1997 | McAbee et al. | |
| 5,645,892 | A | 7/1997 | Whitley et al. | 427/393.4 |
| 5,646,237 | A | 7/1997 | George et al. | |
| 5,648,010 | A | 7/1997 | Dewitt et al. | |
| 5,709,940 | A | 1/1998 | George et al. | |
| 5,725,951 | A | 3/1998 | Schuette et al. | |
| 5,935,484 | A | 8/1999 | Schuette et al. | |
| 5,942,176 | A | 8/1999 | Fujii et al. | |
| 6,093,491 | A * | 7/2000 | Dugan et al. | 428/397 |
| 6,162,890 | A | 12/2000 | George et al. | |
| 6,204,353 | B1 | 3/2001 | Eicken et al. | |
| 6,537,662 | B1 | 3/2003 | Kamrath et al. | |
| 2001/0008823 | A1 | 7/2001 | Ghorashi | |
| 2001/0044249 | A1 | 11/2001 | Demott et al. | |
| 2001/0051706 | A1 | 12/2001 | George et al. | |
| 2002/0007516 | A1 | 1/2002 | Wang | |
| 2002/0056178 | A1 | 5/2002 | Tam et al. | |
| 2002/0189703 | A1 | 12/2002 | Medeiros et al. | |
| 2004/0029473 | A1 * | 2/2004 | McKee et al. | 442/181 |

FOREIGN PATENT DOCUMENTS

| | | |
|---|---|---|
| EP | 0877837 B1 | 10/1999 |
| JP | 6158538 | 6/1994 |
| WO | WO 92/17336 | 10/1992 |
| WO | WO 01/11136 A1 | 2/2001 |
| WO | WO 02/30582 A1 | 4/2002 |

OTHER PUBLICATIONS

Advertisement from Calgati Chemical Company Ltd., dated May 9, 2001.
Extract from "Textile Magazine," Journal, Elsevier Science Ltd, Copyright 2002.
Suchecki et al, Textile Industries (Atlanta), 131(7), pp. 122-123 and seq., 1967.
Kravetz, Textile Chemcist and Colorist, 5(1), pp. 29-34, 1973.
Livengood et al, Textile Chemist and Colorist, 12(4), pp. 67-70, 1080.
Ferguson, American Dyestuff Reporter, 71(6), pp. 43-47, 1982.

* cited by examiner

*Primary Examiner*—Jill Gray
(74) *Attorney, Agent, or Firm*—Cheryl J. Brickey

(57) ABSTRACT

A nonionic hydrophilic macromolecule without added lubricating oil provides lubrication to textured at least partially oriented yarns to protect the yarns during subsequent processing, such as weaving to improve weaving efficiency. Softer yarns and fabrics are obtained than with conventional textured yarns while also providing improved adhesion and dyeability.

7 Claims, No Drawings

LUBRICANT AND SOIL RELEASE FINISH FOR TEXTURED YARNS, METHODS USING SAME AND FABRICS PRODUCED THEREFROM

This invention relates to a method for protecting textured textile filaments, such as textured yarns and filament-containing yarns, prior to and during use, to the textured textile filaments and yarns so produced, and to the fabrics made from such textile filaments and yarns. More particularly, this invention relates to a textured yarn which has been treated with a lubricant finish composition prior to fabric formation, particularly to a textured yarn which has been treated with such lubricant finish which has no added mineral oil or other oil based lubricant. (For purposes of this invention, the term "oil" is meant to define a long chain hydrocarbon or paraffin.)

Prior to fabric formation, synthetic yarn and yarn blends containing synthetic filaments are typically processed to provide increased strength, stretch and bulk, and to enhance their appearance. The processing steps may include heating and drawing to provide a degree of orientation and crystallinity to the yarns, as well as texturing with mechanical action. All of such treated yarns are referred to herein as "textured yarns." Textured yarns, are also referred to as "Draw Textured Yarns." Such textured yarns are produced from continuous filaments and are, therefore, an alternative to and different from spun yarns which are generally formed from staple fiber. Textured filaments or textured yarns are those such as described, for example, in "Encyclopedia of Polymer Science & Engineering", Second Ed. at page 825-827 and include, for example, false twist yarns, including, e.g., single heater stretch yarn and double heater set yarn, tangled/interlaced yarn, air jet (entanglement) textured yarn, stuffer-box textured yarn, water jet textured yarn, hot-air textured yarn, steam-jet textured yarn, and the like. Lubricant is applied to textured yarn to reduce friction and static charge during subsequent processing steps, such as winding, weaving or knitting.

It has recently been proposed by myself and others (see the commonly owned U.S. Pat. Nos. 5,935,484 and 5,725,951, both in the name of Schuette, et al), to provide a soil release treatment which need not be exhausted into the fabric and which may be applied to the yarns prior to fabric formation. The disclosures of these U.S. Pat. Nos. 5,935,484 and 5,725,951 are incorporated herein by reference. According to this earlier work, a finish composition incorporating a lubricating oil and a separate soil release agent which was applied to a yarn as an oil-in-water emulsion. The lubricant protected the yarn during subsequent processing steps, such as winding and fabric formation. The soil release agent improved the washability and moisture transport properties of the yarn and fabrics made therefrom. In these prior disclosures, the lubricant was selected from a wide variety of conventional lubricating oils. By way of example, suitable oils were noted to include (a) mineral oil derivatives, such as, paraffinic, alicyclic and aromatic hydrocarbons and combinations thereof; (b) synthetic oils such as organic esters, alkoxylated fatty acids and alcohols, low molecular weight polyolefins, and silicone oils. However, because of the hydrophobic nature of the lubricating oil, it is necessary to scour the treated yarns to remove the lubricating oil prior to certain downstream processes (e.g. dyeing.) If all of the lubricating oil is not removed, the residual oil is detrimental to the soil release, adhesion, flammability and other properties of the treated yarn.

While it was disclosed by Schuette et al that, "a decrease in the amount of lubricant [is possible] as the soil release agent provides lubrication to the yarn" it was never suggested that the soil release agents were themselves effective, without the aid or assistance of a lubricant oil, to provide the yarn with sufficient lubricity to withstand the subsequent handling and fabric formation steps. However, it has now been unexpectedly and surprisingly discovered that certain classes of soil release agents have sufficiently effective lubricating property, to totally eliminate the need to add mineral oil or other conventional yarn lubricant required as an essential component in the finishing compositions of Schuette, et al, and indeed, believed to be universally essential throughout the textile industry as a whole. This surprising discovery has led to the present invention.

In the following detailed description of the invention, specific preferred embodiments of the invention are described to enable a full and complete understanding of the invention. It will be recognized that it is not intended to limit the invention to the particular preferred embodiment described, and although specific terms are employed in describing the invention, such terms are used in a descriptive sense for the purpose of illustration and not for the purpose of limitation.

Accordingly, the present invention is able to eliminate unnecessary process steps, particularly, the scouring step to remove mineral oil or other oil based lubricant, while at the same time providing treated yarns having various advantageous properties.

It has now been found that certain non-ionic hydrophilic macromolecular compounds are able to totally replace mineral oil lubricants for the treatment of textured yarns. For example, in addition to generally superior lubricating properties, the use of the macromolecular compounds tends to result in a softer textile fabric. During winding, weaving or knitting, the hydrophilic macromolecule lubricant significantly improves processing efficiency. In fact, it has been found that the hydrophilic macromolecular provides sufficient lubrication for the yarns to be used in a variety of fabric manufacturing operations, including high speed processes such as air jet weaving (at speeds great than 800 picks per minute) and other fabric manufacturing processes such as other weaving and knitting processes.

In some embodiments, the non-ionic hydrophilic macromolecular compounds exhibit antistatic property, therefore, it is possible to avoid use of a separate antistatic agent.

Accordingly, in one aspect of the invention there is provided an at least substantially oil-free lubricated textured yarn that has not been formed into a fabric. The textured lubricated yarn has no added wax or oil, and comprises a lubricating effective amount of a nonionic macromolecule formed by vinyl polymerization or condensation reaction, having a hydrophilic component comprising a high molecular weight oxyethylene functionality and a lipophilic component with an affinity for a hydrophobic textile yarn. In a related aspect, fabrics produced from the textured yarns are provided.

In another aspect of the invention, there is provided a process for lubricating textured textile filaments/yarns before converting the filaments/yarns into a fabric. According to this aspect, textured textile filaments are contacted with an at least substantially wax-free and oil-free aqueous emulsion comprising water and nonionic macromolecule formed by vinyl polymerization or condensation reaction, having a hydrophilic component comprising a high molecular weight oxyethylene functionality and a lipophilic component with an affinity for a hydrophobic textile yarn, under conditions which coats the surface of the textured textile filaments with a lubricating-effective amount of the macromolecule. For most embodiments of this invention, a lubricating effective amount will be about 0.01 to about 0.5% on weight of yarn, and even more preferably, about 0.05 to 0.1% on weight of yarn.

In still another aspect of the invention, there is provided a process for forming textured textile filaments or yarns into fabric, comprising applying to textured textile filaments or yarns, from an at least substantially wax-free and oil-free aqueous emulsion, a lubricating-effective amount of a nonionic macromolecule formed by vinyl polymerization or condensation reaction, having a hydrophilic component comprising a high molecular weight oxyethylene functionality and a lipophilic component with an affinity for a hydrophobic textile yarn, to form lubricated textile filaments or yarns, removing the water from the lubricated textile filaments/yarns, and forming the textile filaments/yarns into a fabric.

It is understood that wax and/or oil (e.g., coning oil) may be used during the manufacture of fibers or filament or yarns prior to texturizing and prior to the treatment herein and small amounts of such wax and/or oil may remain on the filaments/fibers/yarns to which the nonionic hydrophilic macromolecule lubricant according to the invention is applied. To account for such residual amounts of wax and/or oil resulting from the filament/fiber/yarn manufacturing process, the term "substantially free from" or "substantially wax-free and oil-free" or equivalent language is used in connection with the lubricated textured yarns according to the invention and the lubricant-containing compositions used herein. Such residual amounts comprehended by "substantially" are less than the amounts which are considered to be effective to provide lubricant effect for the subsequent processing of the lubricated yarns in the production of fabric. Therefore, by the expression, "at least substantially" is intended to include from none to such small residual amounts of oil and/or wax which do not function as lubricant in yarn processing, including during weaving or knitting of yarn into fabric.

When used this application in connection with the finish composition as well as with respect to the lubricated yarns or filaments, the transitional phrase "consisting essentially of" is intended to specifically exclude the addition of wax or oil to the finish composition or yarn which would affect the basic and novel characteristics of the invention. When used in connection with the nonionic hydrophilic macromolecule lubricant, the term "consisting essentially of" is intended to exclude, for example, functional groups, such as, for example, acidic groups, basic groups, ionizable salt groups, water-soluble polymeric groups, anti-oxidant groups, UV absorbing groups, silicon- or fluorine-based water-repellant groups, dyestuff groups, polymeric groups containing a plurality of amide groups, as disclosed for the surface modifying of spun polyester yarns described in U.S. Pat. No. 3,416,952. Also excluded as affecting the basic and novel characteristics of the invention are dimer acid units, such as the ethylene diamine units disclosed in U.S. Pat. No. 3,625,754.

The term "consisting essentially of" when used in connection with the hydrophilic component of the nonionic hydrophilic macromolecule is intended to exclude more than insignificant amounts, which would affect the hydrophilic property of the macromolecule, of oxyalkylene groups, other than the oxyethylene groups. A textile lubricating composition containing both oxyalkylene groups and oxypropylene groups, in a ratio between 3:1 and 1:1 is described in U.S. Pat. No. 3,338,830.

Without limiting the scope of the invention, the preferred embodiments and features are hereinafter set forth. Unless otherwise indicated, all parts and percentages are by weight and conditions are ambient, i.e., one atmosphere of pressure and 25° C. The terms "aryl" and "arylene" are intended to be limited to single and fused double ring aromatic hydrocarbons. Unless otherwise specified, aliphatic hydrocarbons are from 1 to 12 carbon atoms in length, and cycloaliphatic hydrocarbons comprise from 3 to 8 carbon atoms.

A nonionic hydrophilic macromolecular compound is used as lubricant and may also function as a soil release agent, as well as, in some cases, an antistatic agent. The macromolecular compound is applied to an at least partially oriented continuous filament or textured yarn, prior to fabric formation, along with optional functional additives.

The lubricant/soil release agents that are used in the embodiments of the invention are macromolecules having a nonionic hydrophilic component, such as an oxyethylene group, and a lipophilic component with an affinity for the fiber, which functions to add durability or to anchor the soil release/lubricant agent to the fiber surface. The backbone of the macromolecule is generally formed by either vinyl polymerization or condensation reaction. The macromolecules according to an embodiment of the invention have molecular weights (weight average) which may range from a low end of about 500 or about 750 or about 1,000, to a high end of about 100,000, such as about 10,000, or about 20,000, or about 25,000, or about 30,000, or about 40,000 or about 50,000, or about 75,000 or higher. The molecular weight of the macromolecule is such that the nonionic lubricant/soil release agents are normally solid at ambient temperature, e.g., about 25° C. The molecular weight of the hydrophilic oxyethylene group is such that the macromolecule will readily dissolve or emulsify at ambient temperature when contacted with water and provide a lubricating property to hydrophobic (e.g., polyester) fibers when applied thereto within the amounts indicated previously.) For example, the molecular weight of the hydrophilic portion of the macromolecule may range from about 300 to about 5,000, such as from about 400 to about 3,000, for example, a molecular weight of about 300, 400, 500, 750, 800, 1,000, 1,200, 1,500, 1,750, 1,800, 2,000, 2,500, 3,000, or 4,000. The molecular weight of the polyester component is such that the macromolecule has strong affinity to the textile material, and renders the macromolecule a good film-former and able to withstand the forces and treatments to which the treated yarn is likely to be exposed during and following the texturizing processing of the lubricated yarn. By way of example, molecular weights of the lipophilic component may be as high as about 100,000, such as about 10,000, 20,000, 30,000, 40,000, 50,000, 60,000, 75,000, or 80,000.

On the other hand, since the treatment contemplated herein is typically carried out under conditions of high speed, e.g., at least about 1000 m/min., such as at least 2000 m/min or 3000 m/min, or higher, consistent with the formation of partially oriented yarns (POY) or highly oriented yarns (HOY), and at temperatures below temperatures at which the lubricant molecule will chemically react with the chemistry of the textured yarn, the lubricant molecule forms substantially only a surface coating on the filaments/yarns in comparison to the chemical bonding which will occur under the conditions described in U.S. Pat. No. 3,416,952, discussed above. In other words, the present invention involves low temperature processing at this point, which would not achieve the chemical bonding comtemplated in the '952 patent.

In one embodiment, the hydrophilic lubricant macromolecule is a condensation product of aromatic ester groups, such as, dimethyl terephthalate, or other ester-forming derivative of terephthalic acid, ethylene glycol and polyethylene glycol (ethoxylated polyester), especially ethoxylated polyesters having a molecular weight of at least 500.

In one embodiment, the hydrophilic macromolecule lubricant contains from about 10 to 50% by weight of ethylene terephthalate repeat units together with from about 90 to 50% by weight of oxyethylene repeat units, which are usually derived from a polyoxyethylene glycol, and having an average molecular weight of from about 1,000 to about 4,000, and wherein the molar ratio of ethylene terephthalate repeat units to oxyethylene repeat units is from about 1:20 to about 1:2, such as, for example, 1:10, 1:9, 1:8, 1:7, 1:6, 1:5, 1:4, 1:3. One example of a hydrophilic lubricant macromolecule for use in the present invention comprises the reaction product of ethylene glycol, dimethyl terephthalate and a polyoxyethylene glycol containing from 1 to about 50 ethylene oxide repeat units which may be prepared as described, e.g., in Example 11 of U.S. Pat. No. 3,416,952. Another example of a hydrophilic lubricant macromolecule having soil release properties is commercially available from PPG Industries, Inc. under the trademark, "Larosol® 214A". This material is available as an aqueous dispersion of the reaction product of ethylene glycol, dimethyl terephthalate and polyoxyethylene glycol, the latter having an average molecular weight of about 1450. Another commercially available hydrophilic lubricant macromolecule suitable for use in the invention is a product sold by ICI America under the trademark, "Milease® T". The Milease T material is believed to be that prepared according to Example 19 of U.S. Pat. No. 3,416,952. Still another example of a commercially available soil release material which may be used as the hydrophilic lubricant according to the invention are the family of ethoxylated polyesters available from Eastman Chemical under the trademark, Lubril®, such as grade QCX, which is believed to be the reaction product of polyethylene glycol (MW about 3,000 to 4,000) and a high molecular weight (about 50,000) polyethylene terephthalate.

The invention avoids the need for conventional lubricating oils, such as the mineral oil derivatives and synthetic oils which previous hereto were required to be added in or to the finishing compositions. Accordingly, there is no need to subject the yarns or textile fabrics therefrom to scouring nor is there a need to recover these oily substances for recycling or disposal.

Lubricating agents which may be used in embodiments of the invention are commercially available, in the form of an aqueous dispersion, solution or emulsion.

Following application of the present lubricant to the textured yarn, the yarn may be handled and processed as such yarns are treated with conventional finishing compositions. For example, the yarn may be wound into a package and then formed into a fabric, for example, woven or knitted fabric, as is well known in the art, with, if desired, additional lubricant compound added prior to or following fabric formation. The yarn or fabric, because no or only insubstantial amounts of oil or wax component is present in or on the yarn, does not requiring scouring.

In the present invention, the lubricant is applied to textured yarn, prior to fabric formation. The textured yarn may be a continuous multifilament yarn or individual filaments. The yarn may typically have a denier ranging from 30-500 and have a filament count ranging from 10-200, preferably 15-100. The denier and the filament count are not deemed to be critical to the practice of the invention, and yarns outside the stated ranges may be used.

A wide variety of natural and synthetic fibers may be employed. By way of example the fiber substrate may be selected from polyamide fibers, including nylon, such as nylon 6 and nylon 6,6, and aromatic nylons, e.g., Nomex® from E. I duPont de Nemours & Co.; polyester fibers, such as polyethylene terephthalate (PET); polyolefin fibers, such as polypropylene; polyurethane fibers; PLA-based fibers, acrylic fibers, PTT based fibers, blends of the aforementioned synthetic fibers, and blends of such synthetic fibers with cellulosic fibers, such as rayon and acetate. In certain embodiments of the invention, the fiber has a hydrophobic component and is selected from polyamide fibers, polyaramid fibers, polyester or polyesteramide fibers, or blends of any of these fibers with cellulosic fibers, such as acetate, rayon. In addition, the fibers, filaments or yarns may include materials such as antimicrobials, chemical additives, dyes, or the like.

The lubricant-containing composition is applied to the textured yarn in an amount effective to facilitate subsequent processing of the yarn, such as winding, warping and fabric formation, and to enhance the performance of the textile article made from the yarn. The finish composition is applied to achieve a lubricant add on, including optional emulsifiers, of from 0.15 to 6 wt % on the weight of the yarn (owy), such as, 0.375 to 2% owy, e.g., 0.4 owy, 0.5 owy, 0.75 owy, 1.0 owy, 1.25 owy, 1.4 owy, 1.5 owy.

Satisfactory results may be achieved with emulsions containing 45 wt % or greater, preferably, 50 wt % or greater water and compositions having the following ranges may be employed in weight of bath:

0.1 to 10 wt. % of lubricant;
65 to 99.9 wt. % water; and
up to 5 wt. % auxiliaries.

In an embodiment of the invention, the composition is an emulsion having from:

0.5 to 5 wt. % of lubricant;
92 to 99.5 wt. % water;
and up to 3 wt. % auxiliaries.

The concentration of lubricant is intended to include emulsifiers, if necessary or desired to form a more stable emulsion. However, emulsifiers are usually not added to the finishing composition. In some commercial products, however, the lubricant (or soil release agent) is available in the form of aqueous emulsions which may include small amounts of emulsifiers and/or surfactants and such emulsifiers and/or surfactants may be included in the finishing compositions used in the embodiments of the present invention.

Suitable representative auxiliaries include, for example, biocides, antistatic agents (usually not necessary since the lubricant/soil release agent in embodiments of the invention also functions as an antistatic agent), anti-sling agents, and wetting agents, and their use in fiber finishes is well known to those skilled in the art. If desired, dyes or other coloring agents, which, as known to those skilled in the art may be permanent or fugitive, may also be included in the finishing composition.

The lubricant-containing composition is desirably applied at the end of the textured yarn manufacturing process, such as prior to coning. Prior to application of the lubricant, the yarn is texturized, such as by one or more of the following: drawing, twisting, heat setting, entanglement or crimping. In one embodiment, the finish is applied at the texturing frame to textured yarn, e.g., polyester yarn, made from drawn partially oriented yarn (POY).

The lubricant may be applied by conventional techniques used to apply a lubricant emulsion to yarn. By way of example, the lubricant-containing composition may be applied from a kiss roll, metered applicator, sprayer, or by immersion.

It is also within the scope of the invention to apply the lubricant in its dry (solid) form directly to the yarn, by movingly contacting the yarn and lubricant with respect to one another.

It is also within the scope of the invention to apply the lubricant in an organic solvent solution or from an aqueous organic solvent solution.

Following application of the present finish to the textured yarn, the yarn may be handled and processed as are such textured yarns treated with conventional lubricants. For example, the yarn may be wound into a package and then formed into a fabric, such as woven or knitted fabric, as is well known in the art. If desired, additional lubricant may be applied after the yarn is unwound and prior to weaving or knitting. The yarn or fabric may be heat set and even dyed. Since the lubricant is applied early in the yarn processing process, a dyeing step may be eliminated if it is desirable to do so.

The invention may be further understood by reference to the following examples, but the invention is not to be construed as being unduly limited thereby.

EXAMPLE 1

The following example demonstrates the washability and moisture transport performance of a fabric constructed of textured yarn, which has been treated with the lubricant compound of the present invention.

A partially oriented polyester yarn, of 2 ply, 150 denier/34 filaments, was heated, drawn and textured. At the texturing frame, a lubricant/soil release agent finish was applied in emulsion form to the yarn to achieve 0.5 wt %, (owy). The composition of the finish was an ethoxylated polyester soil release agent, identified as Lubril QCX™, available from Eastman Chemical; and water. The lubricated yarn was knitted into a sock.

As control, a second stock was knitted from the identical textured yarn, except that the finishing bath included a mineral oil lubricant instead of the formula referenced above. The control sock was scoured in a 120° F. home wash (12 minute "cotton/sturdy" wash cycle in a residential washing machine with the detergent described in Example 2). The scoured control and unscoured sock according to the invention, Samples A and B, respectively, were then dyed blue (Resolin Blue GFL) in a disperse dye cycle (130° C. for 30 minutes) on a Mathis laboratory jet dyeing machine.

The fabrics were then tested for soil release using corn oil according to AATCC Test Method 130-1977, and moisture transport according to MTCC Test Method 39-1977. The soil release test is designed to measure the ability of a fabric to release oily stains during home laundering. Briefly, a sample fabric is stained with corn oil and washed under conventional home laundry conditions. The samples are then rated on a scale from 1-5, with 1 representing the poorest stain removal and 5 representing the best stain removal.

The yarns manufactured according to the invention were processed in conventional textile fabric formation processes such as weaving and knitting, and performed at stop levels at least as good or better than those traditionally achieved using traditional lubricants. In addition, the fabrics had good dyeability, soil release performance, and wicking performance. In addition, the fabric had good adhesion characteristics due to the absence of oil and wax.

In the specification there has been set forth a preferred embodiment of the invention, and although specific terms are employed, they are used in a generic and descriptive sense only and not for purpose of limitation, the scope of the invention being defined in the claims.

What is claimed is:

1. A process for producing lubricated textiles, comprising in order the steps of:

heating, drawing, and texturizing continuous polyester yarns;

contacting said yarns with a lubricant, said lubricant comprising water and a nonionic hydrophilic macromolecule formed by a vinyl polymerization or a condensation reaction, having a hydrophilic component comprising a high molecular weight oxyethylene functionality and a lipophilic component with an affinity for a hydrophobic filament;

drying the lubricant on the yarns;

winding the yarn into a package; and, forming the yarn into a fabric, wherein the high molecular weight oxyethylene has a weight average molecular weight of between 500 and 100,000, and wherein the process does not include adding a mineral oil or wax lubricant.

2. In a process for producing lubricated textiles, the improvement comprising the elimination of adding an oil or wax based lubricant after texturizing the yarns and the elimination of scouring the oil or wax based lubricant off before forming the yarn into a fabric.

3. The process according to claim 2, wherein the process for producing lubricated textiles consists essentially of the steps of:

heating, drawing, and texturizing continuous polyester yarns;

contacting said yarns with a lubricant, said lubricant comprising water and a nonionic hydrophilic macromolecule formed by a vinyl polymerization or a condensation reaction, having a hydrophilic component comprising a high molecular weight oxyethylene functionality and a lipophilic component with an affinity for a hydrophobic filament;

drying the lubricant on the yarns;

winding the yarn into a package; and, forming the yarn into a fabric, wherein the high molecular weight oxyethylene has a weight average molecular weight of between 500 and 100,000.

4. The process according to claim 3, wherein the step of forming comprises weaving the yarns into a woven fabric.

5. The process according to claim 3, wherein the step of forming comprises knitting the yarns into a knitted fabric.

6. The process according to claim 3, wherein the lubricant is applied to the yarn in an amount of between 0.01% and 0.5% by weight of the yarn.

7. The process according to claim 3, wherein the lubricant is wax-free and oil-free.

* * * * *